US011326351B2

(12) United States Patent
Raine

(10) Patent No.: US 11,326,351 B2
(45) Date of Patent: May 10, 2022

(54) BULL NOSE STAIR NOSING

(71) Applicant: STAIRRODS (UK) LTD, Consett (GB)

(72) Inventor: John Raine, Consett (GB)

( * ) Notice: Subject to any disclaimer, the term of this patent is extended or adjusted under 35 U.S.C. 154(b) by 0 days.

(21) Appl. No.: 16/824,056

(22) Filed: Mar. 19, 2020

(65) Prior Publication Data

US 2020/0299970 A1 Sep. 24, 2020

(30) Foreign Application Priority Data

Mar. 19, 2019 (GB) ..... 1903770
Aug. 23, 2019 (GB) ..... 1912175

(51) Int. Cl.
*E04F 11/16* (2006.01)
*E04F 11/17* (2006.01)
*E04F 11/104* (2006.01)

(52) U.S. Cl.
CPC ..... *E04F 11/166* (2013.01); *E04F 11/17* (2013.01); *E04F 2011/1046* (2013.01)

(58) Field of Classification Search
CPC ..... E04F 11/09; E04F 11/104; E04F 11/108; E04F 11/16; E04F 11/163; E04F 11/166; E04F 11/17; E04F 2011/1046
(Continued)

(56) References Cited

U.S. PATENT DOCUMENTS 1,512,592 A * 10/1924 Frood ..... E04F 11/163 52/179
1,675,198 A * 6/1928 Scott ..... E04F 11/166 52/179
(Continued)

FOREIGN PATENT DOCUMENTS

CN 105971207 A * 9/2016
CN 106150002 A * 11/2016
(Continued)

OTHER PUBLICATIONS

DE 20 2015 105 882 U1 Machine Translation, Espacenet, https://translationportal.epo.org/emtp/translate/?ACTION=description-retrieval&COUNTRY=DE&ENGINE=google&FORMAT=docdb&KIND=U1&LOCALE=en_EP&NUMBER=202015105882&SRCLANG=de&TRGLANG=en (Year: 2020).*
(Continued)

*Primary Examiner* — Ryan D Kwiecinski
(74) *Attorney, Agent, or Firm* — Law Office of Jeff Williams PLLC; J. Oliver Williams

(57) ABSTRACT

A stair nosing comprising an elongate profile member having a back facing configured to abut a bull-nose of a stair tread, a front facing generally opposed to the back facing and a fixing arrangement for facilitating fixing to the bull-nose, wherein, which front facing comprises a longitudinal contact surface configured for contacting a stair tread user's foot and a longitudinal recess adjacent the longitudinal contact surface for receiving a flexible insert, the recess defining a recessed surface of the front facing and wherein the stair nosing is configured to engage with a multi-layer flooring element, which element is disposed on or for disposal on the stair tread, enables easy and effective re-fitting of stairs having a bull nose with multi-layer floor elements, such as LVT, LVP and WPC panels, without unduly compromising aesthetics or durability of the floor elements and without need to reconfigure the bull nose.

16 Claims, 5 Drawing Sheets

(58) Field of Classification Search
USPC ..... 52/177, 179
See application file for complete search history.

(56) References Cited

U.S. PATENT DOCUMENTS

| | | | | | |
|---|---|---|---|---|---|
| 1,681,073 | A * | 8/1928 | Harold | E04F 11/166 | 52/179 |
| 2,288,470 | A * | 6/1942 | Lorraine | E04F 11/166 | 52/179 |
| 2,835,937 | A * | 5/1958 | Hobbs | E04F 11/166 | 52/179 |
| 3,421,274 | A * | 1/1969 | Reiff | E04F 11/166 | 52/179 |
| 4,322,927 | A * | 4/1982 | Scott | B28B 11/00 | 144/136.6 |
| 4,905,431 | A * | 3/1990 | Davis | E04F 11/16 | 52/177 |
| 6,076,936 | A * | 6/2000 | George | F21S 8/032 | 362/146 |
| 6,554,446 | B1 * | 4/2003 | Walsh | F21S 8/032 | 362/131 |
| D519,648 | S * | 4/2006 | Enersen | D25/69 | |
| D621,961 | S * | 8/2010 | Gardner | D25/119 | |
| D649,693 | S * | 11/2011 | Trzesniowski | D26/138 | |
| 8,850,757 | B2 * | 10/2014 | Gardner | E04F 11/163 | 52/179 |
| 2006/0150539 | A1 * | 7/2006 | Vanhastel | E04F 11/175 | 52/179 |
| 2014/0360112 | A1 * | 12/2014 | Gardner | E04F 11/163 | 52/179 |

FOREIGN PATENT DOCUMENTS

| | | | | |
|---|---|---|---|---|
| DE | 29722062 | U1 * | 3/1998 | E04F 11/16 |
| DE | 202005000693 | U1 * | 4/2005 | E04F 19/063 |
| DE | 202007011102 | U1 * | 12/2008 | E04F 11/17 |
| DE | 202015105882 | U1 * | 11/2015 | E04F 11/16 |
| EP | 1604593 | A1 * | 12/2005 | A47G 27/06 |
| FR | 3025818 | A1 * | 3/2016 | F21S 4/28 |
| GB | 2234539 | A * | 2/1991 | E04F 11/16 |
| GB | 2398579 | A * | 8/2004 | A47G 27/06 |
| GB | 2489309 | A * | 9/2012 | E04F 11/166 |
| KR | 20060075264 | A * | 7/2006 | |
| KR | 101504315 | B1 * | 3/2015 | |
| WO | WO-0183912 | A2 * | 11/2001 | E04F 11/166 |
| WO | WO-2006115382 | A1 * | 11/2006 | E04F 11/166 |

OTHER PUBLICATIONS

DE 297 22 062 U1 Machine Translation, Espacenet, https://translationportal.epo.org/emtp/translate/?ACTION=description-retrieval&COUNTRY=DE&ENGINE=google&FORMAT=docdb&KIND=U1&LOCALE=en_EP&NUMBER=29722062&SRCLANG=de&TRGLANG=en (Year: 2020).*

* cited by examiner

BULL NOSE STAIR NOSING

CROSS REFERENCE TO RELATED APPLICATIONS

This application claims the benefit of earlier filing date and right of priority to U.K. Patent Application No. GB1903770.4, filed 19 Mar. 2019, and U.K. Patent Application No. GB1912175.5, filed 23 Aug. 2019, the contents of which are incorporated by reference herein in its entirety.

BACKGROUND OF THE INVENTION

1. Field of the Invention

The present invention pertains generally to the field of stair fittings. More particularly, the present invention relates to stair nosings and methods of fitting stair nosings to stairs.

2. Description of Related Art

Multi-layer flooring, such as luxury vinyl tile (LVT), luxury vinyl plank (LVP) or wood panel composite (WPC) flooring, is increasingly popular. Where such multi-layer flooring is fitted to the floor of a building, identical flooring is often fitted to the treads and risers of the stairs in the building.

Typically, LVT, LVP or WPC flooring panels are provided on the riser and the tread and a suitable trim or nosing provided. In the case of stairs with a bull nose, however, this is not so manageable. One solution offered has been to cut off the bull nose of the tread and fit a panel to the riser, treat and apply a nosing. However, this requires a significant increase in work, damages the stairs (making it difficult to re-establish a stair with bull nose) and reduces the depth of the tread.

The multi-layer flooring elements of this type have limited flexibility and so using the same flooring element on both tread and riser is not viable, particularly where a bull nose is in use.

Another solution that has been tried is to provide nosing having a curved outer surface. In the case of, for example, LVTs, when fitting the tile on the stair tread, it may be fitted by peeling back a flexible upper layer of vinyl, cutting lower layers to fit to the tread, fitting an LVT panel to the riser, attaching the nosing, cutting the excess vinyl layer to length then stretching it over the curved outer surface of the nosing and adhering it thereto. Whilst this provides an aesthetically pleasing result, it is inconvenient to fit, risks flaws in adhesion and leaves the excess vinyl layer in the most footfall exposed position stretched over a typically metal surface, risking damage or tearing.

The present inventor has found a solution to the aforementioned shortcomings in the use of multi-layer flooring on bull-nose stair treads and bull-nose stair nosings.

BRIEF SUMMARY OF THE INVENTION

It is an object of the invention to provide an improved stair nosing configured to engage with a multi-layer flooring element such as LVT, LVP and WPC that allows a robust stair re-fitting easily and efficiently where the stairs have a bull nose.

In accordance with a first aspect of the invention, there is provided a stair nosing comprising an elongate profile member having: a back facing configured to abut a bull-nose of a stair tread; a front facing generally opposed to the back facing; and a fixing arrangement for facilitating fixing to the bull-nose, wherein, the front facing comprises: a longitudinal contact surface configured for contacting a stair tread user's foot; and a longitudinal recess adjacent the longitudinal contact surface for receiving a flexible insert, the recess defining a recessed surface of the front facing and wherein the stair nosing is configured to engage with a multi-layer flooring element, which element is disposed on or for disposal on the stair tread.

In a second aspect of the invention, there is provided a method of fitting a stair nosing to a stair having a bull nose, the method comprising the steps of: providing one or more multi-layer flooring elements and fitting to the tread of a stair and optionally to a riser of the stair, the flooring elements having an outer edge disposed closer to the bull nose, which flooring element is fitted and configured to define a predefined spacing between the outer edge and a distal edge of the bull nose; providing a stair nosing as defined above and adapted to have a length to fit the stair; fitting the stair nosing over the bull nose so that the stair nosing engages with the multi-layer flooring element, by abutting and or projecting over the edge; securing the stair nosing to the stair by applying fixings through fixing apertures in a recessed surface of the stair nosing and into the bull nose; and fitting an insert into the recess in the front facing of the stair nosing, the insert preferably comprising one or more upper layers of a multi-layer flooring element.

The stair nosing of the invention enables easy and effective re-fitting of stairs having a bull nose with multi-layer floor elements, such as LVT, LVP and WPC panels, without unduly compromising aesthetics or durability of the floor elements and without need to reconfigure the bull nose.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1A:
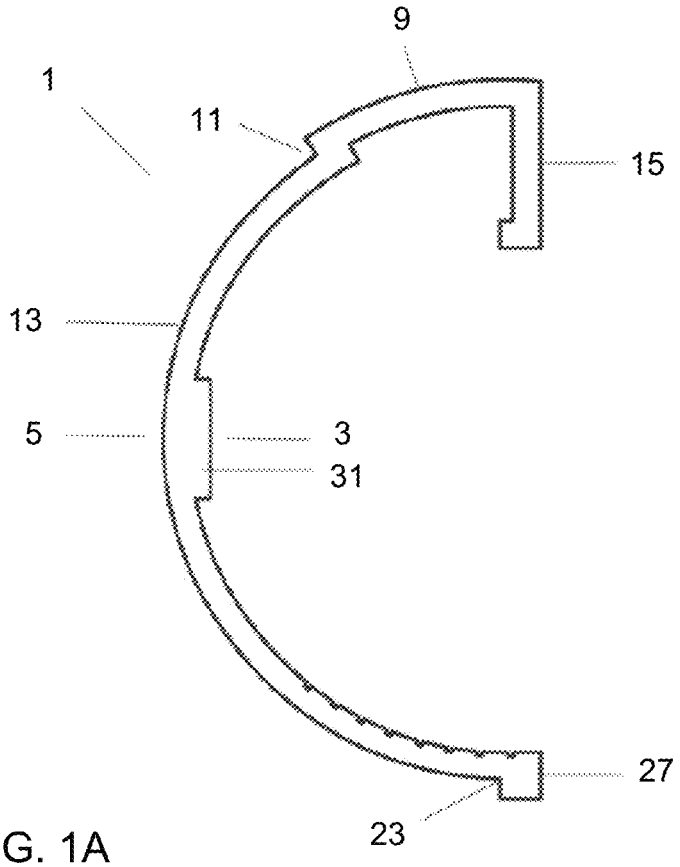
FIG. 1A is a cross sectional view of an embodiment of the invention.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

The invention is directed to a stair nosing comprising an elongate profile member. The elongate profile member has a back facing, a front facing and a fixing arrangement. The back facing is configured to abut a bull-nose of a stair tread. The fixing arrangement is for facilitating fixing of the elongate profile member to the bull-nose of the stair. The front facing is generally opposed to the back facing and comprises a longitudinal contact surface for contacting a stair tread user's foot and a longitudinal recess adjacent the longitudinal contact surface for receiving a flexible insert. The recess defines a recessed surface of the front facing. The stair nosing is configured to engage with a multi-layer flooring element, which is disposed on or for disposal on the stair tread.

The stair nosing may optionally be used with any multi-layer flooring element for use on stairs. The multi-layer flooring element typically comprises several layers compressed or laminated together to form a durable flooring element. Preferably, the multi-layer flooring element comprises one or more backing layers which are for contact with the surface to be floored, one or more performance layers to provide durability and/or other product features and preferably at least one aesthetic layer to provide the desired appearance.

Preferably, the multi-layer flooring element is one or any combination of two or more of vinyl tile, vinyl plank, luxury vinyl tile, luxury vinyl plank, wood panel composite, self-adhesive vinyl tile, sheet vinyl, vinyl click flooring, laminate flooring, carpet, carpet tiles, or laminate.

More preferably, the multi-layer flooring element is one or any combination of two or more of luxury vinyl tile, luxury vinyl plank or wood panel composite.

Most preferably, the multi-layer flooring element is a luxury vinyl tile, a luxury vinyl plank or a wood panel composite.

The multi-layer flooring element may have any suitable thickness, and is optionally from 0.5 mm to 30 mm thick. Preferably, the multi-layer flooring element has a thickness of 1 mm to 20 mm, more preferably 2 to 15 mm, most preferably 6 to 10 mm.

The flexible insert may be any suitable insert that can be received in the recess. Typically, the flexible insert is selected to be similar in one or any combination of two or more of color, texture, pattern, embossing or grain to the multi-layer flooring element.

In one embodiment, the flexible insert is produced from materials which are identical to one or more materials used to form the multi-layer flooring element. Most preferably, the flexible insert is produced from the upper layers or topmost layer of the multi-layer flooring element, preferably comprising the aesthetic layer and one or more performance layers (which are typically transparent or translucent). This may be produced by cutting a sample of the multi-layer flooring element, then peeling off one or more upper layers for use as the insert. The flexible insert may be secured in place using a glue or resin applied to the back or, optionally, the bottom surface of the flexible insert may be self-adhesive.

In a further option, the recessed surface is configured for receiving a flexible layer of vinyl or wood panel composite flooring.

Preferably, the elongate profile member has a length equal to the width of the stair (that is from side to side, e.g. along the length of a bull nose). The elongate profile member may alternatively have a length less than the width of the stair and extend along just a portion thereof, such as from one third of the length to three quarters of the length and in any case preferably at least half the length. More preferably, the elongate member covers at least 70%, more preferably at least 80%, still more preferably at least 90% and more preferably still at least 95% of the width of the stair. Where the elongate profile member has a length less than the width of a stair, it preferably is provided with an end member on one or both ends that is attachable thereto to provide end members on the profile member. Preferably, however, the stair nosing comprises only the elongate profile member and preferably consists essentially of the elongate profile member.

In a preferred embodiment, the length of the elongate profile member can be adjusted (e.g. cut) to fit a stair. In a still further example, two or more elongate profile members fit a stair.

The elongate profile member preferably has a back facing configured to abut a bull-nose of a stair tread. At least a portion of the back facing may contact the bull-nose when properly fitted. Preferably, at least 10%, optionally at least 15%, for example anywhere in the range from 20 to 95%. Optionally the entirety of the back facing contacts a bull-nose, but preferably no more than say 90%, optionally at most 85%, e.g. up to 75%.

Preferably, at least a portion of the back facing is curved. Preferably, from 20 to 95% of the surface area of the back facing is curved and preferably a curve of constant radius.

In one embodiment, the back facing is generally concave.

Preferably, the radius of the curvature of the back facing is equal or larger than the radius of the curvature of the bull-nose. More preferably, the radius of the curvature of the back facing is larger than the radius of the curvature of bull-nose.

The elongate profile member has a front facing generally opposed to the back facing, wherein the front facing comprises: a longitudinal contact surface configured for contacting a stair tread user's foot; and a longitudinal recess adjacent the longitudinal contact surface for receiving a flexible insert, the recess defining a recessed surface of the front facing.

Preferably the front facing is curved. More preferably, the front facing has a curvature which generally follows the curvature of the bull-nose of the stair tread. Optionally, the front facing has a curvature which generally follows the curvature of the back facing.

Preferably, the radius of the curvature of the front facing is larger than the radius of the curvature of the bull-nose.

In one embodiment, the front facing has a generally front convex curved surface.

Preferably, the longitudinal recess has a depth and/or the longitudinal recess is configured to receive a flexible insert having a thickness of from 0.1 to 10 mm, preferably 0.5 to 7.5 mm, more preferably 1 to 5 mm, optionally 1.5 to 3 mm.

Preferably, the longitudinal recess extends the length of the front facing, preferably from end to end of the elongate profile member, and is preferably equal to the length of the longitudinal contact surface.

The longitudinal recess defines a recessed surface of the front facing. In one embodiment, the recessed surface is a convex curved surface. Preferably, the recessed convex curved surface is curved about an axis coincident or parallel with a longitudinal axis of the elongate profile member.

In a further embodiment, the recess convex curved surface has a constant radius of curvature Preferably, the recess convex curved surface has a radius of curvature in the range from 10 to 50 mm, more preferably up to 40, still more preferably 30, for example 25 mm, such as 12 to 20 mm and more preferably 14 to 16 mm.

The recessed surface preferably has a surface area that makes up at least 10% of the surface are of the front facing, more preferably at least 25%, for example anywhere from 30 to 95%, more preferably at least 50%, still more preferably at least 70%, e.g. at least 75%, more preferably at least 80%, such as up to 90%.

In one embodiment, the stair nosing has a generally curved configuration about an axis coincident or parallel with a longitudinal axis of the elongate profile whereby the front facing is generally convex and the back facing is generally concave.

In one embodiment, the front facing comprises an elongate retaining lip extending over a portion of the recess to define an upper recess slot in the longitudinal recess in the front facing and configured to retain or engage a flexible insert disposed in the recess, the elongate retaining lip defining at least a portion of the longitudinal contact surface. Preferably, the elongate retaining lip extends over a portion of the recess by in the range of 1.5 to 20 mm, more preferably 3 to 15 mm, most preferably 5 to 10 mm, for example about 7.5 mm.

A recess slot allows a planar insert to be retained within the recess and preferably is configured so that the insert is a snug fit within the recess slot so that it is secured therein.

Preferably the longitudinal recess is defined by a recessed surface, a first or upper recess edge member proximal to the longitudinal contact surface and a second or lower recess edge member distal from the longitudinal contact surface. An insert is preferably provided to cover the full extent of the recessed surface.

In one embodiment, the recessed surface of the front facing is characterized by a shoulder running longitudinal the length of the nosing, which shoulder defines a greater or deeper recess in the front facing. The shoulder is preferably disposed proximal to an elongate retaining lip. The shoulder defines a portion of the front facing which may be considered a recessed slot surface.

Optionally, a distal lip member extends from the second recess edge member over at least a portion of the recess defining a lower recess slot to retain a flexible insert. Preferably, a distal lip member extends over a portion of the recess by in the range of 1.5 to 20 mm, more preferably 3 to 15 mm, such as from 3 to 5 mm or from 5 to 10 mm, for example about 7.5 mm. Such a lower recess slot allows for retention of a flexible insert in the same way as a recess slot above. Preferably, a second shoulder is provided on the front facing which defines a deeper recess in the front recess and defines a lower recessed slot surface. In one embodiment, both an (upper) recess slot and a lower recess slot may be provided, whereby an insert may be secured without adhesion. Optionally, an insert may be slid into the recess slots before fitting the nosing to the stair, without the need for adhesion.

The elongate profile member has a fixing arrangement for facilitating fixing to the bull-nose.

In one embodiment, the fixing arrangement comprises a plurality of fixing apertures in the elongate profile member extending from the recessed surface through the back facing, the fixing apertures for receiving fixings. Preferably, the fixings are screws and/or nails. Preferably, the fixing apertures are configured such that the fixings may secure the nosing to a bull nose of a stair.

In a further embodiment, the fixing arrangement comprises applying an adhesive to the back facing of the stair nosing and/or to the surface of the bull-nose of the stair tread before contacting the back-facing of the stair nose with the bull-nose. Preferably, the adhesive is a glue.

Preferably, the fixing arrangement comprises a plurality of fixing apertures in the elongate profile member for receiving fixings, and applying adhesive to the back facing of the stair nose and/or to the surface of the bull-nose.

Optionally, the fixing arrangement comprises a plurality of fixing nails pre-attached to the back facing, or integral members of the back facing, protruding backwardly from the back facing of the elongate profile member.

Preferably, the elongate profile member comprises a stiffening member disposed on the back facing. More preferably, the stiffening member is disposed on the back facing about the fixing apertures. Most preferably, the stiffening member is disposed on the back facing along an axis parallel with a longitudinal axis of the elongate profile.

In a one embodiment, at least a portion of the longitudinal contact surface is formed on a projecting member configured for extending beyond an edge of a multi-layer flooring element disposed on the stair tread and engaging with a top surface of the element.

Preferably, the stair nosing further comprises a first side facing configured for abutting an edge of a multi-layer flooring element, which element is disposed on or for disposal on the stair tread. The first side facing may preferably contact the surface of the stair tread. Preferably, the first side facing has a depth corresponding to the thickness of the multi-layer flooring.

In one embodiment, the longitudinal contact surface is disposed adjacent to the first side facing so that the longitudinal contact surface may sit flush with a top surface of the multi-layer flooring element disposed on the stair tread.

In another embodiment, the longitudinal contact surface is configured to extend beyond the side facing so that it may extend over an edge of a multi-layer flooring element abutting the first side facing.

In a further embodiment, the elongate profile member further comprises a second side facing, distal from the longitudinal contact surface and proximal to a second or lower recess edge member.

Optionally, the second side facing is parallel or coplanar with the first side facing.

In a further option, when the stair nosing is fitted to a stair, the second side facing is configured to abut a riser or a multi-layer flooring element disposed on a riser. Preferably, however, the nosing is configured such that the second side facing does not abut a riser, but leaves a small gap between the second side facing and the riser (e.g. about 5 to 20 mm, such as after the riser has been fitted with a multi-layer flooring element).

Preferably, the stair nosing is formed of one or a combination of metal (e.g. stainless steel, chrome, brass or aluminium) or wood.

The longitudinal contact surface preferably is configured on the elongate profile member so as to extend over a cusp of the tread as it becomes a bull nose. Preferably, in use, at least a portion of the longitudinal contact surface is disposed over the stair tread and at least a portion is disposed over the bull nose. The longitudinal contact surface preferably provides robustness and rigidity, in situ, that receives the worst of the footfall on the stairs, so protecting the edge of the multi-layer flooring element and an insert disposed in the recess of the nosing. The longitudinal contact surface preferably comprises an area of at least 10% of the area of the front facing, preferably up to 50%, e.g. from 15 to 30% such as from 20 to 25%.

In a second aspect of the invention there is provided a method of fitting a stair nosing to a stair having a bull nose, the method comprising the steps of: providing one or more multi-layer flooring elements and fitting to the tread of a stair and optionally to a riser of the stair, the flooring elements having an outer edge disposed closer to the bull nose, which flooring element is fitted and configured to define a predefined spacing between the outer edge and a distal edge of the bull nose; providing a stair nosing as defined above and adapted to have a length to fit the stair; fitting the stair nosing over the bull nose so that the stair nosing engages with the multi-layer flooring element, by abutting and or projecting over the edge; securing the stair nosing to the stair by applying fixings through fixing apertures in a recessed surface of the stair nosing and into the bull nose; and fitting an insert into the recess in the front facing of the stair nosing, the insert preferably comprising one or more upper layers of a multi-layer flooring element. In a preferred embodiment, a section of multi-layer flooring not used for the flooring on the stair is cut to size, an upper portion comprising one or more layers, typically including protective upper layers and an aesthetic layer, at least, are peeled off the section and inserted into the recess of the bull nosing, and optionally secured there with an adhesive resin.

In another aspect of the invention, there is provided a method of manufacturing a stair nosing of the present invention, which comprises moulding (e.g. injection or cast, but preferably injection) the nosing of a material comprising polymer, a fibre reinforced polymer or filled polymer (e.g. filled with a pigment or other colorant), pultruding the nosing of a fibre reinforced polymer (e.g. carbon fibre, metal fibre or glass fibre, for example) optionally filled with a filler such as a pigment or colorant, or extruding a material of metal or polymer, which metal may optionally be coated (e.g. powder coated) to give a predefined finish which contrasts or complements an aesthetic layer of a multi-layer flooring element.

In a preferred embodiment there is provided a stair nosing comprising an elongate profile member having: a back facing configured to abut a bull-nose of a stair tread; a front facing generally opposed to the back facing; a fixing arrangement for facilitating fixing to the bull-nose; and a first side facing for abutting an edge of a multi-layer flooring element, which element is disposed on or for disposal on the stair tread; wherein, the front facing comprises: a longitudinal contact surface configured for contacting a stair tread user's foot; and a longitudinal recess adjacent the longitudinal contact surface for receiving a flexible insert, the recess defining a recessed surface of the front facing, and wherein the stair nosing is configured to engage with the multi-layer flooring element. Preferably, the longitudinal contact surface is disposed adjacent to the first side facing so that the longitudinal contact surface may sit flush with a top surface of the multi-layer flooring element disposed on the stair tread. More preferably, the elongate profile member further comprises a stiffening member disposed on the back facing about the fixing apertures.

In a second preferred embodiment there is provided a stair nosing comprising an elongate profile member having: a back facing configured to abut a bull-nose of a stair tread; a front facing generally opposed to the back facing; a fixing arrangement for facilitating fixing to the bull-nose; and a first side facing for abutting an edge of a multi-layer flooring element, which element is disposed on or for disposal on the stair tread; wherein, the front facing comprises: a longitudinal contact surface configured for contacting a stair tread user's foot; and a longitudinal recess adjacent the longitudinal contact surface for receiving a flexible insert, the recess defining a recessed surface of the front facing, and wherein the stair nosing is configured to engage with the multi-layer flooring element. Preferably, the longitudinal contact surface is disposed adjacent to the first side facing so that the longitudinal contact surface may sit flush with a top surface of the multi-layer flooring element disposed on the stair tread. More preferably, the stair nosing further comprises an elongate retaining lip extending over a portion of the recess to define an upper recess slot in the longitudinal recess in the front facing and configured to retain or engage a flexible insert disposed in the recess, the elongate retaining lip defining at least a portion of the longitudinal contact surface. Most preferably, the elongate profile member further comprises a stiffening member disposed on the back facing about the fixing apertures. Optionally, the longitudinal recess is defined by a recessed surface, a first or upper recess edge member proximal to the longitudinal contact surface and a second or lower recess edge member distal from the longitudinal contact surface, wherein a distal lip member extends from the second recess edge member over at least a portion of the recess defining a lower recess slot to retain a flexible insert.

In one preferred embodiment of the second embodiment, the recessed surface of the front facing comprises a shoulder proximal to the elongate retaining lip (and preferably a second shoulder proximal to the distal or lower lip), which shoulder defines a deeper recess in the front facing which extends into the slot and defines a recessed slot surface portion of the front facing (and the front recess surface) and preferably also a corresponding deeper recess and recessed slot surface associated with a lower or distal slot.

In a third preferred embodiment there is provided a stair nosing comprising an elongate profile member having: a back facing configured to abut a bull-nose of a stair tread; a front facing generally opposed to the back facing; a fixing arrangement for facilitating fixing to the bull-nose; and a first side facing for abutting an edge of a multi-layer flooring element, which element is disposed on or for disposal on the stair tread; wherein, the front facing comprises: a longitudinal contact surface configured for contacting a stair tread user's foot; and a longitudinal recess adjacent the longitudinal contact surface for receiving a flexible insert, the recess defining a recessed surface of the front facing, and wherein the stair nosing is configured to engage with the multi-layer flooring element. Preferably, at least a portion of the longitudinal contact surface is formed on a projecting member configured for extending beyond an edge of a multi-layer flooring element disposed on the stair tread and engaging with a top surface of the element. More preferably, the elongate profile member further comprises a stiffening member disposed on the back facing about the fixing apertures. Optionally, the stair nosing further comprises an elongate retaining lip extending over a portion of the recess to define an upper recess slot in the longitudinal recess in the front facing and configured to retain or engage a flexible insert disposed in the recess, the elongate retaining lip defining at least a portion of the longitudinal contact surface. In a further option, the longitudinal recess is defined by a recessed surface, a first or upper recess edge member proximal to the longitudinal contact surface and a second or lower recess edge member distal from the longitudinal contact surface, wherein a distal lip member extends from the second recess edge member over at least a portion of the recess defining a lower recess slot to retain a flexible insert. In a still further option according to this embodiment, the recess front surface is characterized by a shoulder proximal to the elongate retaining lip and optionally a second shoulder proximal to the distal lip, which each define a deeper recess which extends into the respective slot and defines a recessed slot surface.

The invention will now be described in more detail, without limitation, with reference to the accompanying Figures.

In FIG. 1A there is provided a cross sectional view of a stair nosing 1 according to one embodiment comprising a back facing 3 which is generally concave and configured to abut a bull-nose of a stair tread, and a front facing 5 which is generally convex and generally opposed to the back facing 3. The front facing 5 comprises a longitudinal contact surface 9 configured for contacting a stair tread user's foot, a longitudinal recess 11 adjacent the longitudinal contact surface 9 for receiving a flexible insert, which longitudinal recess 11 defines a recessed surface 13 of the front facing 5. A first side facing 15, configured for abutting an edge of a multi-layer flooring element (which element is disposed on or for disposal on the stair tread) is disposed adjacent the longitudinal contact surface 9 so that the longitudinal contact surface 9 may sit flush with a top surface of the multi-layer flooring element disposed on the stair tread. A lower recess edge member 23, distal from the longitudinal contact surface 9, is disposed adjacent a second side facing 27. A stiffening member 31 is disposed on the back facing 3.

Figure 1B:
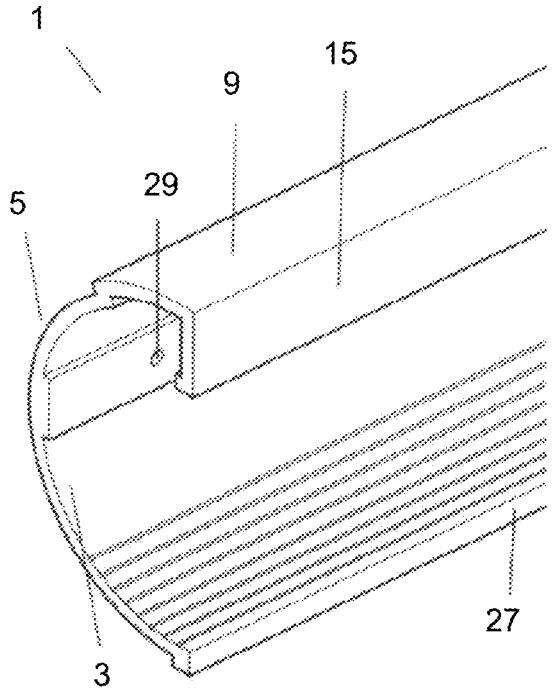
FIG. 1B is a three-dimensional view of the embodiment of the invention illustrated in FIG. 1A.

In FIG. 1B, there is provide a three-dimensional view of a stair nosing 1 according to the same embodiment of FIG. 1A, further comprising a plurality of fixing apertures 29 extending from the recessed surface through the back facing for receiving fixings (all but one of fixing apertures 29 obscured by the first side edge 15).

Figure 2A:
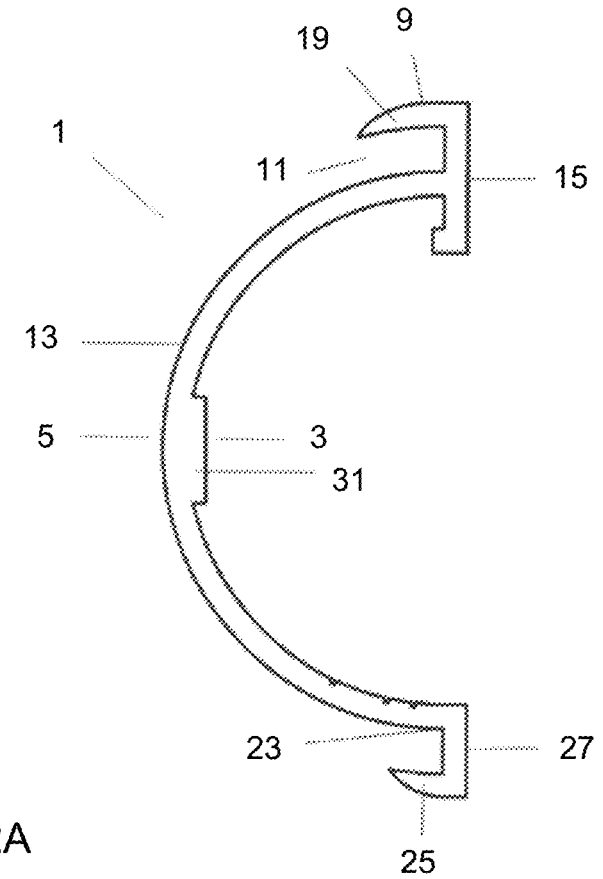
FIG. 2A is a cross sectional view of an embodiment of the invention.

In FIG. 2A there is provided a cross sectional view of a stair nosing 1 according to one embodiment comprising a back facing 3 which is generally concave and configured to abut a bull-nose of a stair tread, and a front facing 5 which is generally convex and generally opposed to the back facing 3. The front facing 5 comprises a longitudinal contact surface 9 configured for contacting a stair tread user's foot, a longitudinal recess 11 adjacent the longitudinal contact surface 9 for receiving a flexible insert, which longitudinal recess 11 defines a recessed surface 13 of the front facing 5. A first side facing 15, configured for abutting an edge of a multi-layer flooring element (which element is disposed on or for disposal on the stair tread) is disposed adjacent the longitudinal contact surface 9 so that the longitudinal contact surface 9 may sit flush with a top surface of the multi-layer flooring element disposed on the stair tread. An elongate retaining lip 19 defining a portion of the longitudinal contact surface 9 extends over a portion of the longitudinal recess 11 to define an upper recess slot in the longitudinal recess 11 configured to retain or engage a flexible insert disposed in the recess. A lower recess edge member 23, distal from the longitudinal contact surface 9, is disposed adjacent a second side facing 27. A distal lip member 25 extends from the second recess edge member 23 over a portion of the longitudinal recess 11 to define a lower recess slot to retain a flexible insert. A stiffening member 31 is disposed on the back facing 3.

Figure 2B:
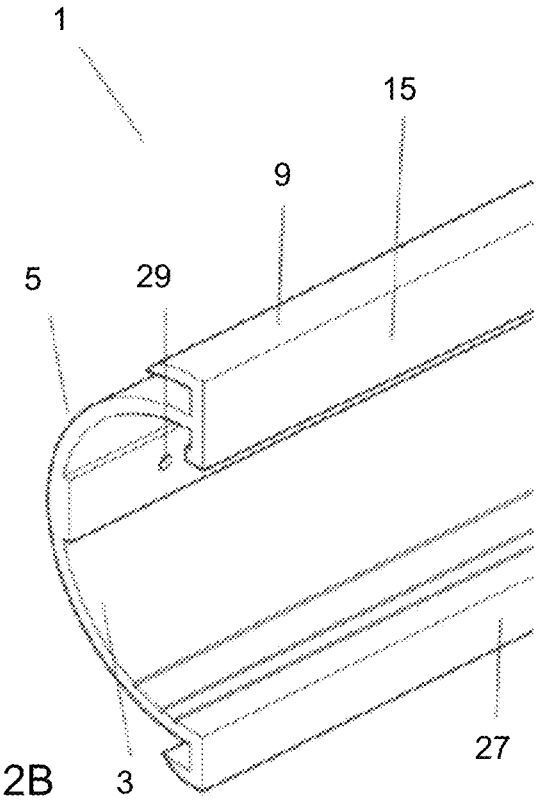
FIG. 2B is a three-dimensional view of the embodiment of the invention illustrated in FIG. 2A.

In FIG. 2B, there is provide a three-dimensional view of a stair nosing 1 according to the same embodiment of FIG. 2A, further comprising a plurality of fixing apertures 29 extending from the recessed surface through the back facing for receiving fixings (all but one of fixing apertures 29 obscured by the first side edge 15).

Figure 3A:
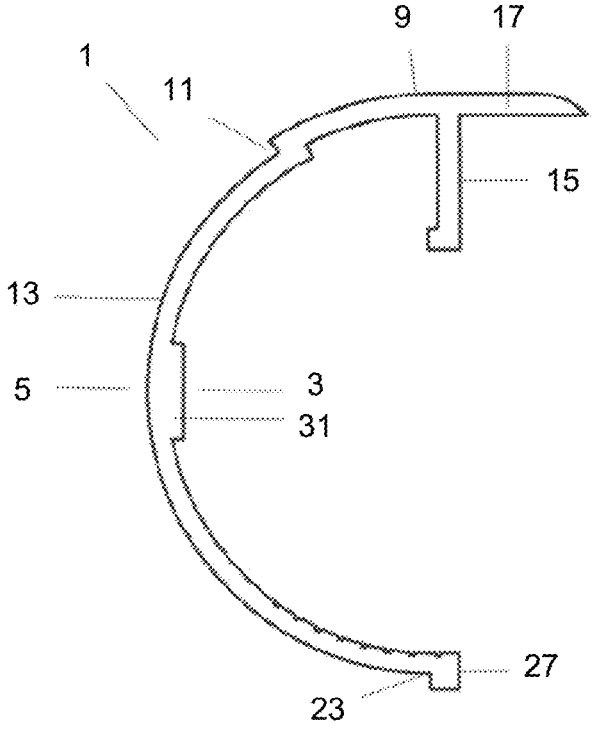
FIG. 3A is a cross sectional view of an embodiment of the invention.

In FIG. 3A there is provided a cross sectional view of a stair nosing 1 according to one embodiment comprising a back facing 3 which is generally concave and configured to abut a bull-nose of a stair tread, and a front facing 5 which is generally convex and generally opposed to the back facing 3. The front facing 5 comprises a longitudinal contact surface 9 configured for contacting a stair tread user's foot, a longitudinal recess 11 adjacent the longitudinal contact surface 9 for receiving a flexible insert, which longitudinal recess 11 defines a recessed surface 13 of the front facing 5. A first side facing 15 is configured for abutting an edge of a multi-layer flooring element (which element is disposed on or for disposal on the stair tread). A projecting member 17 forming a portion of the longitudinal contact surface 9 is configured for extending beyond an edge of a multi-layer flooring element disposed on the stair tread and engaging with a top surface of the element. A lower recess edge member 23, distal from the longitudinal contact surface 9, is disposed adjacent a second side facing 27. A stiffening member 31 is disposed on the back facing 3.

Figure 3B:
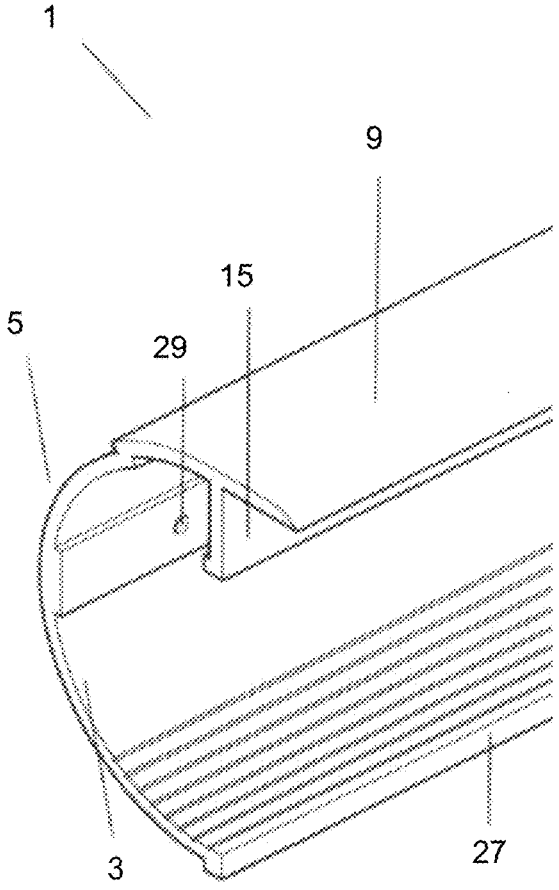
FIG. 3B is a three-dimensional view of the embodiment of the invention illustrated in FIG. 3A.

In FIG. 3B, there is provide a three-dimensional view of a stair nosing 1 according to the same embodiment of FIG. 3A, further comprising a plurality of fixing apertures 29 extending from the recessed surface through the back facing for receiving fixings (all but one of fixing apertures 29 obscured by the first side edge 15 and the longitudinal contact surface 9).

Figure 4A:
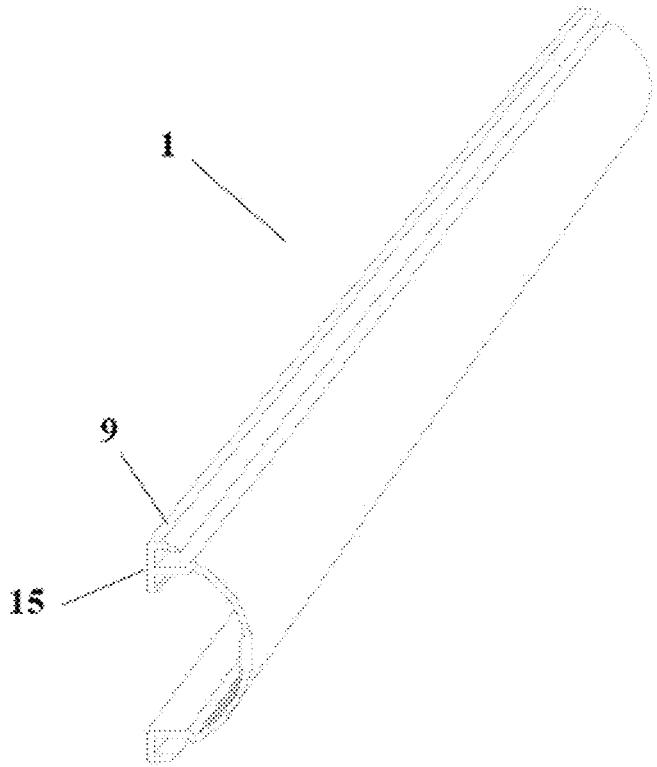
FIG. 4A is a three-dimensional perspective view of another embodiment of the invention.
Figure 4B:
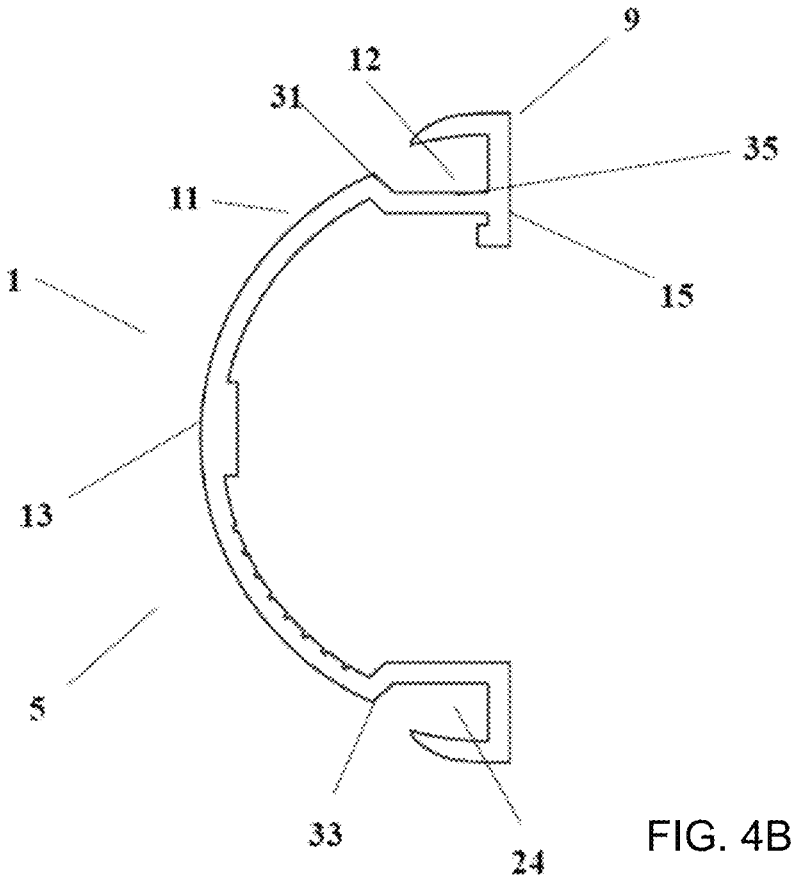
FIG. 4B is a cross-sectional view of the embodiment of FIG. 4A.

FIGS. 4A and 4B illustrate a nosing 1 similar to that illustrated in FIGS. 2A and 2B in that it has a first side facing 15 configured to abut an edge of a multi-layer flooring element and disposed adjacent a longitudinal contact surface 9. Like that in FIGS. 2A and 2B, the present embodiment also has an elongate retaining lip 19 and distal lip member 25, which each extend over respective portions of the longitudinal recess 11 to define upper and lower recess slots 12,24 for receiving a flexible insert. The present embodiment differs in that there is formed on the recess front surface 13 a proximal shoulder 31 proximal to the elongate retaining lip 19 and a distal shoulder 33 proximal to the distal lip member 25. These shoulders 31,33 define a further recessed surface to the peripheral edges of the front facing 5 which forms a recessed slot surface 35, which serves to increase the depth of the recess within the recess slot 12 relative to the recess 11 defined by the remainder of the front facing 5 (and the recess surface 13). Indeed, while recessed front surface 13 appears to protrude relative to the recess slot surface 35, it remains recessed relative to lips 19,25. In use, prior to inserting a flexible insert, glue may be deposited in the recess slot to adhere the flexible insert and also to fill up the additional space provided in the recess slot.

Figure 5A:
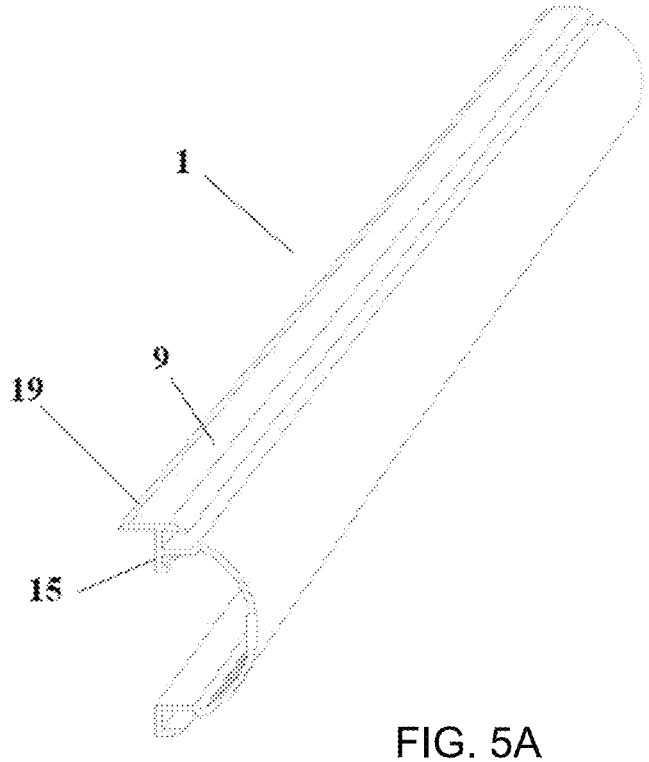
FIG. 5A is a three-dimensional perspective view of another embodiment of the invention.
Figure 5B:
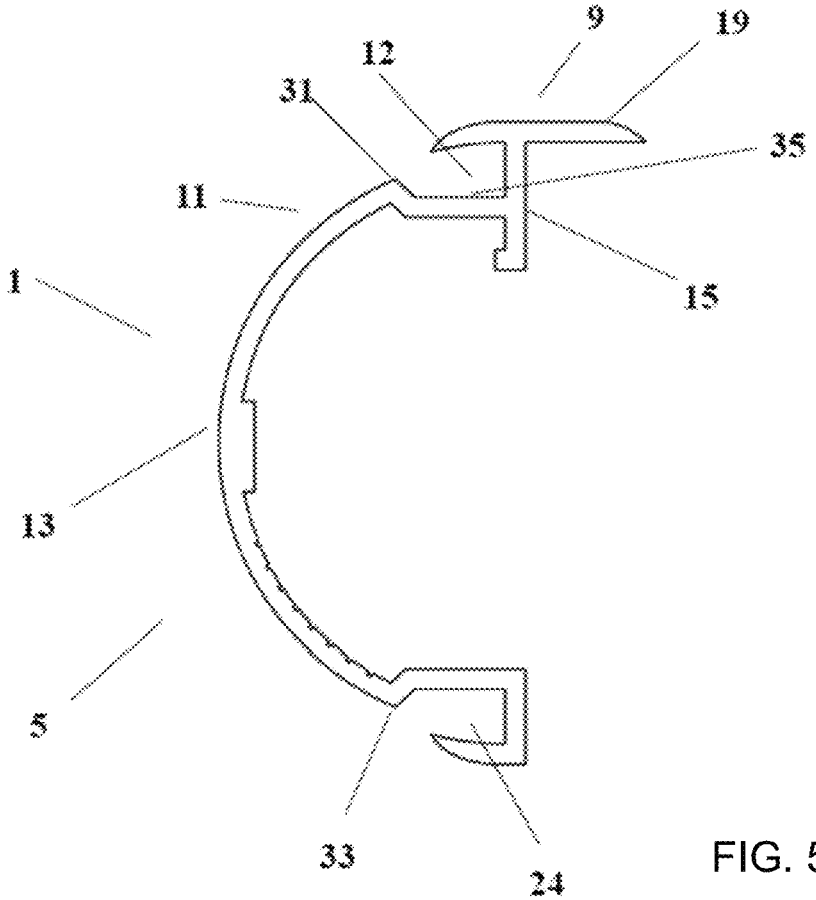
FIG. 5B is a cross-sectional view of the embodiment of FIG. 5A.

FIGS. 5A and 5B correspond with those in FIGS. 4A and 4B, except in the present embodiment in FIGS. 5A and 5B, the side facing 15 has extending beyond its edge a projecting member 17 forming a portion of the longitudinal contact surface 9 which may extend beyond an edge of a multi-layer flooring element disposed abutting side facing 15.

The invention has been described with reference to preferred embodiments. However, it will be appreciated that variations and modifications can be effected by a person of ordinary skill in the art without departing from the scope of the invention.

What is claimed is:

1. A stair nosing comprising an elongate profile member having:

a back facing configured to abut a bull-nose of a stair tread;

a front facing generally opposed to the back facing; and a fixing arrangement for facilitating fixing to the bull-nose, wherein, the front facing comprises:

a longitudinal contact surface configured so as to extend over a cusp of the tread as it becomes a bull nose for contacting a stair tread user's foot; and a longitudinal recess adjacent the longitudinal contact surface for receiving a flexible insert, the recess defining a recessed convex curved surface of the front facing having a constant radius of curvature in the range from 10 to 50 mm;

wherein the elongate profile member further comprises:

an elongate retaining lip extending over a portion of the recess to define an upper recess slot in the longitudinal recess in the front facing and configured to retain or engage a flexible insert disposed in the recess, the elongate retaining lip defining at least a portion of the longitudinal contact surface, and a first side facing configured for abutting an edge of a multi-layered flooring element, which element is disposed on or for disposal on the stair tread, wherein the longitudinal contact surface is disposed adjacent to or configured to extend beyond the first side facing, and wherein a bottom of the first side facing is configured to contact a tread surface of the stair tread.

2. The stair nosing according to claim 1, wherein the longitudinal contact surface is disposed adjacent to the first side facing so that the longitudinal contact surface sits flush with a top surface of the multi-layer flooring element disposed on the stair tread.

3. The stair nosing according to claim 1, wherein at least a portion of the longitudinal contact surface is formed on a projecting member configured for extending beyond an edge of a multi-layer flooring element disposed on the stair tread and engaging with a top surface of the element.

4. The stair nosing according to claim 1, wherein the longitudinal contact surface is configured to extend beyond the side facing so that it extends over an edge of a multi-layer flooring element abutting the first side facing.

5. The stair nosing according to claim 1, wherein the recessed front surface defines a shoulder proximal to the upper recess slot defining a further recess on the front surface and thereby defining a recessed slot surface.

6. The stair nosing according to claim 1, wherein the recess is defined by a recessed surface, a first or upper recess edge member proximal to the longitudinal contact surface and a second or lower recess edge member distal from the longitudinal contact surface, wherein a distal lip member extends from the second recess edge member over at least a portion of the recess defining a lower recess slot to retain a flexible insert.

7. The stair nosing according to claim 1, wherein the recessed convex curved surface extends to a shoulder proximal to the upper recess slot, which shoulder defines a further recess of the front surface into the upper recess slot.

8. The stair nosing according to claim 1, wherein the convex curved surface is curved about an axis coincident or parallel with a longitudinal axis of the elongate profile member.

9. The stair nosing according to claim 1, having a generally curved configuration about an axis coincident or parallel with a longitudinal axis of the elongate profile whereby the front facing is generally convex and the back facing is generally concave.

10. The stair nosing according to claim 1, wherein the elongate profile member further comprises a second side facing, distal from the longitudinal contact surface and proximal to a second or lower recess edge member.

11. The stair nosing according to claim 10, wherein, when the stair nosing is fitted to a stair, the second side facing is configured to abut a riser or a multi-layer flooring element disposed on a riser.

12. The stair nosing according to claim 1, wherein the recess has a depth and/or the recess is configured to receive a flexible insert having a thickness of from 0.5 to 7.5 mm.

13. The stair nosing according to claim 1, which is configured to engage with a multi-layer flooring element disposed on a stair tread, which multi-layer flooring element has a thickness of from 1 mm to 20 mm.

14. The stair nosing according to claim 13, which further comprises a first side facing configured for abutting an edge of a multi-layer flooring element, which first side facing has a depth corresponding to the thickness of the multi-layer flooring.

15. The stair nosing according to claim 1, wherein the fixing arrangement comprises a plurality of fixing apertures in the elongate profile member extending from the recessed surface through the back facing, the fixing apertures for receiving fixings, wherein the elongate profile member comprises a stiffening member disposed on the back facing about the fixing apertures.

16. The stair nosing according to claim 1, which is formed of one or a combination of metal and wood, and wherein the recessed surface is configured for receiving a flexible layer of vinyl or wood panel composite flooring.

* * * * *